US012663244B2

(12) United States Patent
Sedita

(10) Patent No.: US 12,663,244 B2
(45) Date of Patent: Jun. 23, 2026

(54) TARGETING SYSTEM WITH PROJECTILE BRAKING AND RECOVERY DEVICE

(71) Applicant: Joseph Sedita, Seyssins (FR)

(72) Inventor: Joseph Sedita, Seyssins (FR)

( * ) Notice: Subject to any disclaimer, the term of this patent is extended or adjusted under 35 U.S.C. 154(b) by 242 days.

(21) Appl. No.: 18/602,018

(22) Filed: Mar. 12, 2024

(65) Prior Publication Data

US 2024/0310149 A1 Sep. 19, 2024

(30) Foreign Application Priority Data

Mar. 16, 2023 (FR) ..... 2302460

(51) Int. Cl.
*F41J 13/00* (2009.01)
*F41J 5/14* (2006.01)

(52) U.S. Cl.
CPC ..... *F41J 13/00* (2013.01); *F41J 5/14* (2013.01)

(58) Field of Classification Search
None
See application file for complete search history.

(56) References Cited

U.S. PATENT DOCUMENTS 5,715,739 A * 2/1998 White ..... F41J 13/02 273/404
7,134,233 B1 * 11/2006 Saur ..... F41A 9/60 42/98
7,275,748 B2 * 10/2007 Lambert ..... B23K 11/0053 273/410
9,146,083 B2 * 9/2015 Lamothe ..... F41J 13/00
10,371,489 B2 * 8/2019 Wall ..... F41J 13/00
2005/0034594 A1 * 2/2005 Parks ..... F41J 13/00 89/1.11

FOREIGN PATENT DOCUMENTS

DE 44 36 060 A1 4/1996
DE 102 21 527 A1 12/2003
FR 2 865 534 7/2005

* cited by examiner

*Primary Examiner* — Sunit Pandya
(74) *Attorney, Agent, or Firm* — Nixon Peabody LLP

(57) ABSTRACT

A device is configured for braking and recovering projectiles and includes a support from which several braking tubes are suspended. The braking tubes are suspended by one of their ends on the support. The device further includes a motor driving the support in rotation about an axis of rotation. The braking tubes are suspended from the support by gravity so as to absorb the energy of a projectile impacting one or more of the several braking tubes.

12 Claims, 7 Drawing Sheets

TARGETING SYSTEM WITH PROJECTILE BRAKING AND RECOVERY DEVICE

CROSS-REFERENCE TO RELATED APPLICATIONS

This application claims priority to and the benefit of French Application No. 2302460, filed Mar. 16, 2023, which is incorporated by reference in its entirety.

FIELD OF THE INVENTION

The present disclosure relates generally to target shooting, and more specifically, to securing environments in which projectiles move and are stopped, such as a targeting system having a device for braking and recovering projectiles propelled by weapons towards targets.

BACKGROUND OF THE INVENTION

Shooting with handguns or long guns using compressed air, gas, or gunpowder as propulsion energy is a widespread practice. The shooting is generally practiced at shooting ranges, either outdoors (such as in sport shooting or biathlon) or indoors (such as in indoor shooting), where the aim is to hit one or more successive targets with a projectile propelled by the weapon.

For obvious reasons of safety and available space, it is necessary to stop the projectile once it has hit the intended target. Projectiles can have energies ranging from a few joules to several thousand joules. However, because targets are generally consumables, they present very little obstacle to the projectile and, therefore, do not enable the desired stopping function to be achieved.

It is possible to place mounds of sand or earth behind each target to stop the projectile after it has passed through the target. However, these mounds are bulky, difficult to set up in certain stands, and not very flexible. Moreover, the mounds do not allow easy recovery of the projectiles after they are stopped, because the projectiles are buried in the mound, which is further problematic in terms of pollution and recycling.

Alternatively, cages, known as bullet traps, are set up just behind each target. These bullet traps present an obstacle strong enough to stop the projectile. To do this, the bullet traps use a fixed wall, often made of metal, which impedes the projectile's trajectory.

In biathlon, the projectile passes through a hole in a first steel plate that is used as a sight and which comes crashing down on a steel paddle in the background. The steel paddle is usually black and is positioned behind the hole in the first plate. The impact of the projectile on a background vane causes the projectile to brake and, above all, the vane to tilt, thus confirming that the shot has passed through the orifice in the first steel plate, which serves as a visual plate.

However, such bullet traps or pallets can cause projectiles to deflect in dangerous directions, such as towards the shooter, which is problematic for safety. Furthermore, stopping the projectile on a wall, plate or pallet, for example, causes it to crush, releasing dust from the projectile. The projectiles usually used are made of metallic materials, such as lead, whose dust is harmful to health and the environment. A projectile often loses a portion of its mass—around 2-3%—when stopped by such means. This explains why air pollution at shooting ranges can in some cases exceed the tolerated threshold of 100 micrograms/cubic meter (μg/m3), and why surface pollution can reach values several hundred times higher than the tolerated threshold of 1,000 micrograms/square meter (μg/m$^2$). These bullet traps therefore present significant safety and pollution problems, dispersing lead dust into the air at the shooting range. More so, for biathlon, current targeting systems are not only inaccurate in the event of contact between the projectile and the edge of the orifice of the first steel plate serving as a sight plate, but also require human intervention to change the size of the orifice of the first steel plate, depending on whether the shooting position is upright or prone.

French Patent Publication No. FR 2865534 proposes the use of a system having vertical fabric tubes positioned in a housing supporting a target. These tubes are fixed to the top wall of the housing and are designed to slow down projectiles fired at the targets. However, the concentration of shots at the center of the target causes significant wear to the central tubes, greatly reducing the service life of such a system. As a result, such a system cannot reliably brake or recover a large number of successive projectiles without requiring maintenance or replacement of certain tubes.

The present disclosure provides a solution for these and other problems.

SUMMARY OF THE INVENTION

The term embodiment and like terms, e.g., implementation, configuration, aspect, example, and option, are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter. This summary is also not intended to be used in isolation to determine the scope of the claimed subject matter. The subject matter should be understood by reference to appropriate portions of the entire specification of this disclosure, any or all drawings, and each claim.

One aim of the present disclosure is to solve at least one of the aforementioned problems, by enabling, for example, the reliability of firing results and the recovery of moving projectiles to be improved while reducing the release of polluting particles and the risk of the projectile rolling back in a simple and time-efficient manner.

To this end, according to one aspect of the present disclosure, a projectile braking and recovery device is proposed, including:

- a support from which a number of braking tubes or bands are suspended, the braking tubes or bands being suspended from the support by one of their ends;
- a motor driving the support in rotation about an axis of rotation; and
- the braking tubes or bands are suspended from the support by gravity so as to absorb the energy of a projectile impacting a braking tube or band.

This device improves projectile braking by opposing a greater number of tubes at the trajectories most often traversed by projectiles, i.e., those passing through the center of the target. This way, the number of tubes used is reduced to a strict minimum in the trajectories less frequently traversed by projectiles, i.e., on the sides in relation to the firing axis.

In addition, despite the higher concentration of shots passing through the center of the device, wear and tear is distributed over all the tubes by rotating them in such a way as not to always present the same tube behind the center of the target. This increases the device's service life before the first maintenance.

Advantageously, but optionally, the exposed device includes at least one of the following features, taken alone or in any combination:

- the braking tubes or bands are arranged on the support in several annular alignments around the axis of rotation;
- the support is a plate whose axis of rotation is parallel to the brake tubes, the brake tubes being suspended by one end on an underside of the support and the alignments being concentric;
- adjacent brake tubes in the same alignment and adjacent brake tubes in adjacent alignments are spaced apart by a distance greater than 1 millimeter (mm) and less than the diameter of the brake tubes;
- each straight line passing through the center of rotation of the plate intercepts at least one of the brake tubes of at least one of the alignments;
- the support is a shaft, parallel to the axis of rotation and perpendicular to the brake bands hanging from the support, each alignment of brake bands being arranged around the support and the alignments being juxtaposed along the axis of rotation of the support;
- the support includes, for each braking tube or band:
  - a hole in which the tube or brake band can slide freely, and a shoulder for securing the tube or brake band to the support, the shoulder being wider than the hole in the support into which the tube or brake band is fitted;
  - the device includes a housing defining a cavity inside which the support and the braking tubes or bands are positioned, the housing including a lateral opening parallel to the axis of rotation of the support for the entry of projectiles into the device;
- the device includes a braking plate for braking a projectile, the braking plate being positioned parallel to the axis of rotation and perpendicular to a trajectory of a projectile and being configured to brake a projectile before the projectile impacts a braking tube or band;
- the braking plate is made of polyurethane;
- the motor is positioned on a top cover of the housing and outside the cavity, the motor being connected to the disc by a connecting fastener (such as a screw) fixed to the disc on the one hand and to the motor on the other, and passing through the top cover;
- the disc is supported by the top cover by a mechanism including:
  - the connecting screw and a pin, locking the connecting screw in translation with respect to the top cover of the housing, and
  - a needle stop, on which the pin rests, allowing rotation of the connecting screw relative to the cover.

According to another aspect, a targeting system is proposed including a device as previously described and an electronic target, the electronic target being positioned in front of the device so that a projectile passing through the target is then braked (or stopped) and recovered by the device.

Advantageously, the targeting system includes:

- a display device for displaying the effectiveness and/or success of a shot; and
- the display device controlled by an electrical signal emitted by the target as a function of a trajectory of a projectile in the target and a setting of the target.

According to certain aspects of the present disclosure, a device is configured for braking and recovering projectiles, and includes a support from which several braking tubes are suspended. The braking tubes are suspended by one of their ends on the support. The device further includes a motor driving the support in rotation about an axis of rotation. The braking tubes are suspended from the support by gravity so as to absorb the energy of a projectile impacting one or more of the several braking tubes.

According to certain aspects of the device disclosed above, the braking tubes are arranged on the support in a plurality of annular alignments around the axis of rotation.

According to certain aspects of the device disclosed above, the support is a plate whose axis of rotation is parallel to the braking tubes, the braking tubes being suspended by one end on a lower face of the support, the plurality of annular alignments being concentric.

According to certain aspects of the device disclosed above, adjacent braking tubes of the same alignment and adjacent braking tubes of adjacent alignments are spaced apart by a distance greater than 1 millimeter (mm) and less than a diameter of the braking tubes.

According to certain aspects of the device disclosed above, each straight line passing through a center of rotation of the plate intercepts at least one of the braking tubes of at least one of the plurality of annular alignments.

According to certain aspects of the device disclosed above, the support is a shaft extending around the axis of rotation, the support being perpendicular to the braking tubes hanging, each one of the plurality of annular alignments being arranged around the support and juxtaposed along the axis of rotation of the support.

According to certain aspects of the device disclosed above, support further includes for each braking tube of the braking tubes a hole in which the braking tube slides freely; and a shoulder for securing the braking tube to the support, the shoulder being wider than the hole in the support into which the braking tube is inserted.

According to certain aspects of the device disclosed above, the device further includes a housing defining a cavity within which the support and the braking tubes are positioned, the housing including a lateral opening that is parallel to the axis of rotation of the support, the lateral opening being configured as an entry to receive projectiles into the device.

According to certain aspects of the device disclosed above, the motor is positioned on a top cover of the housing and outside the cavity, the motor being connected to a disc via a connecting fastener that is fixed to the disc and to the motor, the connecting fastener passing through the top cover.

According to certain aspects of the device disclosed above, the disc is supported by the top cover via the connecting fastener and a pin, the pin locking the connecting fastener in translation with respect to the top cover of the housing, the disc being further supported via a needle stop on which the pin rests and which allows rotation of the connecting fastener relative to the cover.

According to certain aspects of the device disclosed above, the device further includes a braking plate for braking a projectile, the braking plate being positioned parallel to the axis of rotation and perpendicular to a trajectory of a projectile, the braking plate being configured to brake the projectile before the projectile impacts one or more of the braking tubes.

According to certain aspects of the device disclosed above, the braking plate is made of polyurethane.

According to certain aspects of the present disclosure, a targeting system includes a device for braking and recovering projectiles. The device includes a support from which several braking tubes are suspended. The braking tubes are suspended by one of their ends on the support. The device further includes a motor driving the support in rotation about an axis of rotation. The braking tubes are suspended from the support by gravity so as to absorb the energy of a projectile impacting one or more of the several braking tubes. The targeting system further includes an electronic target positioned in front of the device so that a projectile passing through the target is then braked and recovered by the device.

According to certain aspects of the targeting system disclosed above, the targeting system further includes a display device for displaying at least one of an effectiveness and a success of a shot.

According to certain aspects of the targeting system disclosed above, the display device is controlled by an electrical signal emitted by the target, the signal being a function of a trajectory of a projectile in the target and a setting of the target.

The above summary is not intended to represent each embodiment or every aspect of the present disclosure. Rather, the foregoing summary merely provides an example of some of the novel aspects and features set forth herein. The above features and advantages, and other features and advantages of the present disclosure, will be readily apparent from the following detailed description of representative embodiments and modes for carrying out the present invention, when taken in connection with the accompanying drawings and the appended claims. Additional aspects of the disclosure will be apparent to those of ordinary skill in the art in view of the detailed description of various embodiments, which is made with reference to the drawings, a brief description of which is provided below.

BRIEF DESCRIPTION OF THE DRAWINGS

The disclosure, and its advantages and drawings, will be better understood from the following description of representative embodiments together with reference to the accompanying drawings. These drawings depict only representative embodiments and are therefore not to be considered as limitations on the scope of the various embodiments or claims.

DETAILED DESCRIPTION OF PRODUCTION METHODS

Figure 1:
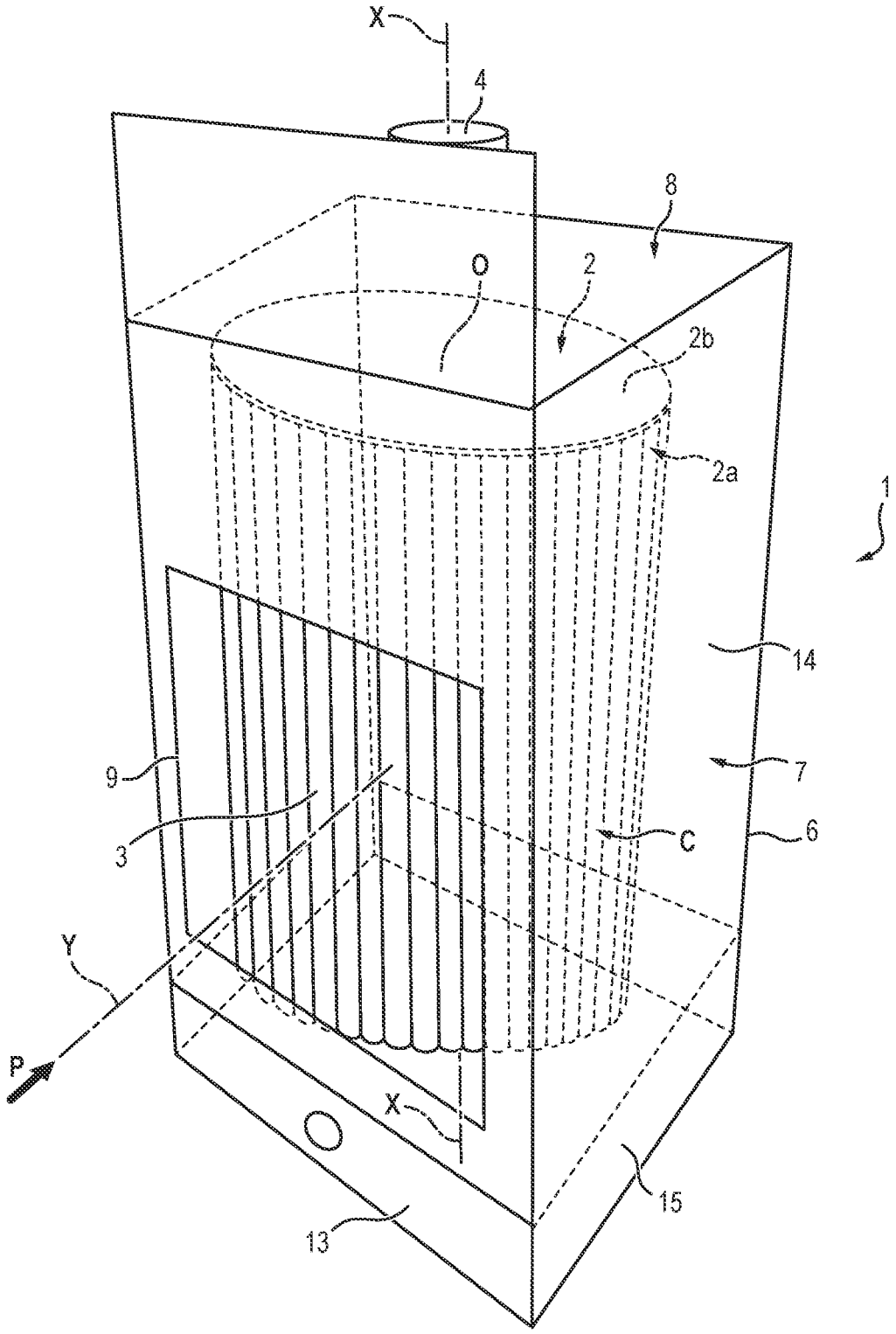
FIG. 1 is a perspective view illustrating a braking and projectile recovery device, according to according to certain aspects of the present disclosure.

Various embodiments are described with reference to the attached figures, where like reference numerals are used throughout the figures to designate similar or equivalent elements. The figures are not necessarily drawn to scale and are provided merely to illustrate aspects and features of the present disclosure. Numerous specific details, relationships, and methods are set forth to provide a full understanding of certain aspects and features of the present disclosure, although one having ordinary skill in the relevant art will recognize that these aspects and features can be practiced without one or more of the specific details, with other relationships, or with other methods. In some instances, well-known structures or operations are not shown in detail for illustrative purposes. The various embodiments disclosed herein are not necessarily limited by the illustrated ordering of acts or events, as some acts may occur in different orders and/or concurrently with other acts or events. Furthermore, not all illustrated acts or events are necessarily required to implement certain aspects and features of the present disclosure.

For purposes of the present detailed description, unless specifically disclaimed, and where appropriate, the singular includes the plural and vice versa. The word "including" means "including without limitation." Moreover, words of approximation, such as "about," "almost," "substantially," "approximately," and the like, can be used herein to mean "at," "near," "nearly at," "within 3-5% of," "within acceptable manufacturing tolerances of," or any logical combination thereof. Similarly, terms "vertical" or "horizontal" are intended to additionally include "within 3-5% of" a vertical or horizontal orientation, respectively. Additionally, words of direction, such as "top," "bottom," "left," "right," "above," and "below" are intended to relate to the equivalent direction as depicted in a reference illustration; as understood contextually from the object(s) or element(s) being referenced, such as from a commonly used position for the object(s) or element(s); or as otherwise described herein.

In the remainder of this description, radial will be taken to mean that which is directed by a vector colinear with a radius, and axial will be taken to mean that which is directed by a vector colinear with an axis of rotation. In addition, as the device forming the subject of the invention is intended to be positioned relative to the ground, the part of a component closer to the ground in the direction of gravity will be referred to as the lower part, compared with a part, referred to as the upper part, less close to the ground in the direction of gravity.

A targeting system 100 may include one or more targets 200 and a braking and projectile recovery device 1 P.

The target 200 carries one or more visual markers for the shooter to aim at, and the braking and recovery device 1 stops the projectile P fired by the shooter downstream of the target 200.

The braking and recovery device 1 includes a support 2, from which a number of braking tubes 3 are suspended, and a motor 4 which drives the support 2 in rotation about an axis of rotation X. The braking bands 3 are referred below as braking tubes 3, for simplicity, but it is understood by one of ordinary skill in the art that the braking tubes 3 can be braking tubes, braking bands, or braking strips. By rotating the support 2, the motor 4 ensures that the same braking bands 3 are not always presented to the projectiles P. Indeed, different successive P projectiles can be braked by encountering different braking tubes 3. Wear on the braking tubes 3 is thus distributed over each of the braking tubes 3.

The braking tubes 3 hang from the support 2 by gravity and are suspended from the support 2 by one of their ends 3*b*. The braking tubes 3 are configured to absorb the energy of a projectile P impacting them.

The braking tubes 3 are arranged in several sub-assemblies relative to the support 2, the sub-assemblies being referred to as alignments 5. In each alignment 5, the braking tubes 3 are arranged at regular intervals from one another around the axis of rotation X. Alignments 5 can be arranged radially or axially with respect to the axis of rotation X on the support 2. Each alignment 5 may be annular in order to present a uniform obstacle to the projectile despite the rotation of the support 2.

Low-Energy Braking and Projectile Recovery System

In one embodiment, the support 2 is a plate on which the brake tubes 3 are suspended. The motor 4 drives the plate 2 in rotation on itself around the axis of rotation X, the axis of rotation X being parallel to the tubes 2 (in other words, vertical, or parallel to the direction of gravity).

Figure 2A:
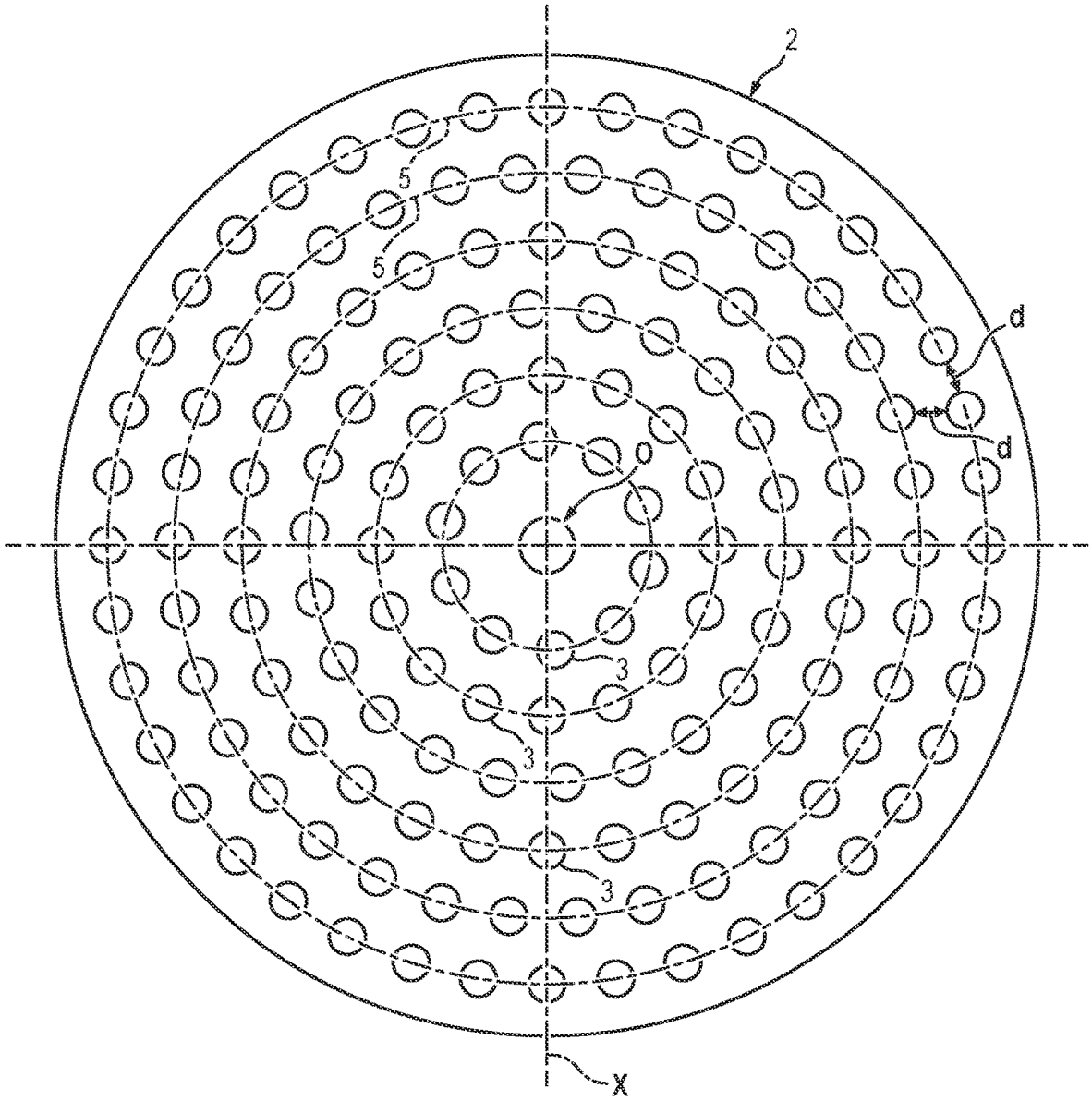
FIG. 2A is a top cross-sectional view illustrating a plate or disk on which tubes will be hooked, according to one embodiment and certain aspects of the present disclosure.
Figure 2B:
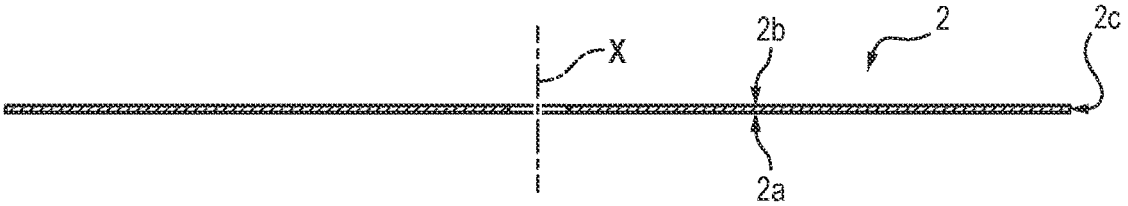
FIG. 2B is a side cross-sectional view illustrating a plate or disk on which tubes will be hooked, according to the one embodiment and certain aspects of the present disclosure.

The plate 2, as illustrated in FIGS. 2A and 2B, includes a so-called lower face 2*a*, a so-called upper face 2*b* and an edge 2*c*. The plate 2 also has a center of gravity O and an axis orthogonal to the lower 2*a* and upper 2*b* faces and passing through the center of gravity O. In the following, and due to the geometry of plate 2, the plate will be assimilated to a single plane. Plate 2 has a maximum length and a minimum length in the plane orthogonal to the axis. The shape of plate 2 is such that the difference between the dimensions of the maximum length and the minimum length is small compared with the dimension of the maximum length. In this way, the evolution of the length of the projection of the slice 2*c*, on a fixed plane orthogonal to the plate 2, during the rotation of the plate 2 around its axis, is small compared to the maximum length of the plate 2. Thus, the surface area presented by the tubes 3 suspended from the rotating plate 2 is relatively constant over time. Advantageously, the plate 2 forms a regular polygon or preferably a circle. In a preferred embodiment, plate 2 is a disk.

Figure 3:
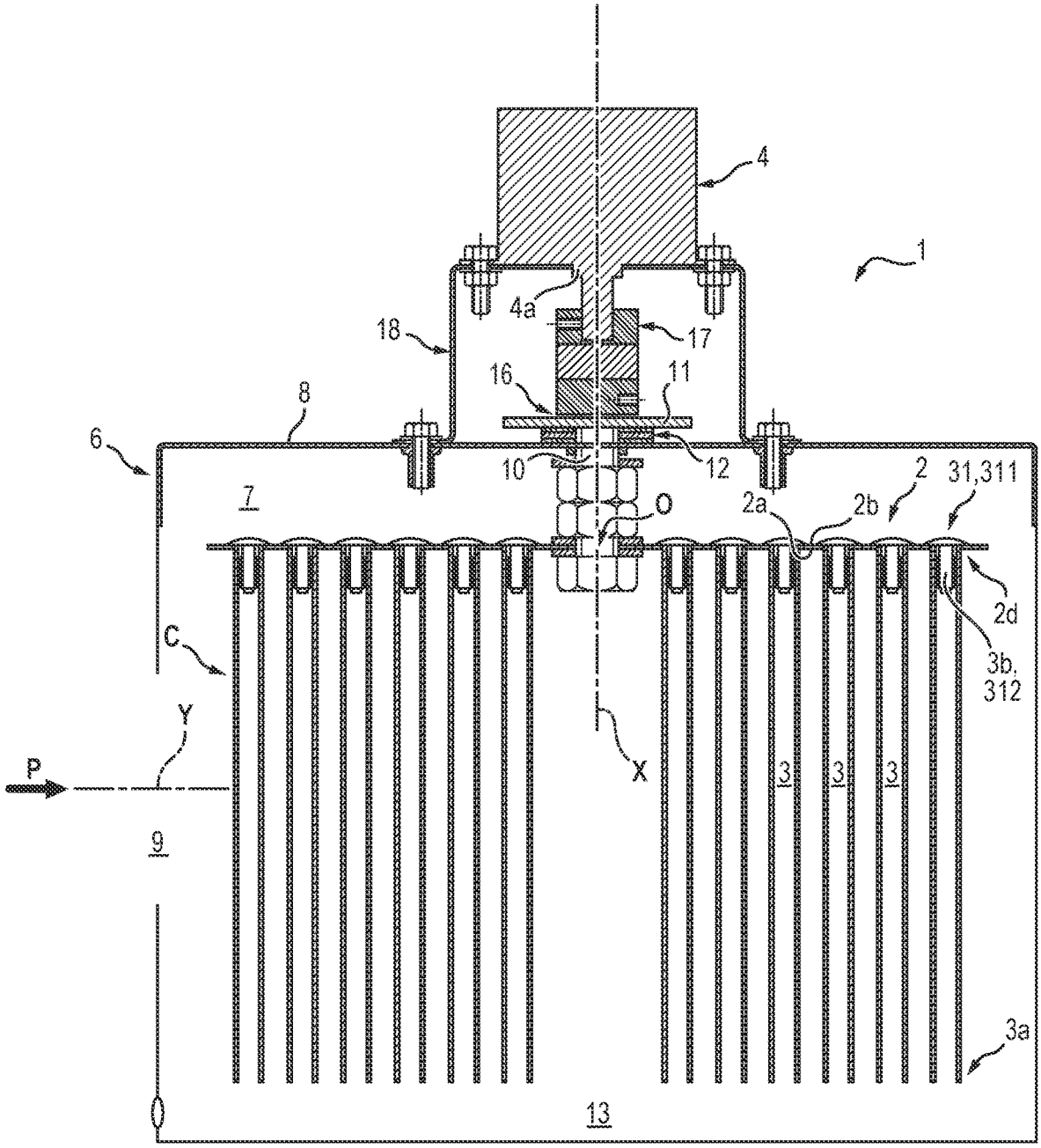
FIG. 3 is a side cross-sectional view illustrating a braking and projectile recovery device, according to another embodiment and certain aspects of the present disclosure.

The tubes 3, as shown in FIG. 3, include an upper end 3*b* and a lower end 3*a*. Their upper end 3*b* is hooked onto the lower face 2*a* of the plate 2 and their lower end 3*a* is free to move. For each tube 3, the plate 2 includes a hole 2*d* in which the tube 3 can slide freely. Each tube 3 has a shoulder 31 attached to or in the mass of the tube. The shoulder 31 has a head 311 which is wider than the hole 2*d* in the plate 2. Each shoulder 31, thus, enables a tube 3 to be fixed to the plate 2. This facilitates replacement of a single tube 3 and simplifies attachment of each tube 3 to the plate 2.

The tubes 3 are suspended from the plate 2 by gravity and are therefore all parallel to each other. In this way, they are allowed to swing so that they can absorb the energy of projectiles P through their deformation and movement.

The tubes 3 are preferably cylindrical in shape and circular in cross-section, so as not to present any angular parts to the projectiles P. In this way, when the projectile P comes into contact with a tube 3, this cylindrical shape favors the lateral repulsion effect of the tube 3 and thus reduces the risk of severing it.

In one embodiment, the tubes 3 are hollow, which improves the absorption of the energy of the projectile P by the tube 3.

Tubes 3 are made of a flexible material, so as to be able to absorb the energy of projectiles P. Tubes 3 can be made of polymer-type materials of fossil, recycled or biological origin, such as elastomer, polyurethane elastomer, polyvinyl chloride, thermoplastic, synthetic rubber, or other similar materials. Tubes 3 can also be made of soft natural materials such as natural rubber, leather or other similar materials. In this way, the tubes 3 absorb the energy of the projectile P by deforming and swaying, thus preventing deformation of the projectile P itself.

Advantageously, and as illustrated in FIG. 2A, the tubes 3 are arranged on the underside 2*a* of the plate 2 in one or more alignments 5 centered on the barycenter O of the plate 2. The various alignments 5 of tubes 3 are therefore concentric. The volume defined by all these alignments 5 of tubes 3 will hereafter be referred to as the cylinder C of tubes 3, and the axis of rotation X will be the axis parallel to the tubes 3 and passing through the barycenter O of the plate 2. A firing axis Y is also referred to as an axis perpendicular to the axis of rotation X. Preferably, the different tubes 3 of each alignment 5 are not all positioned on the same radii; in other words, each straight line passing through the barycenter of the plate 2 intercepts at least one of the tubes 3 of at least one of the alignments 5 of tubes 3 fixed to the underside of the plate 2. In one embodiment, the tubes 3 of adjacent alignments 5 are staggered, so that the trajectory of a projectile P cannot intersect two successive alignments 5 without encountering at least one tube 3.

Advantageously, tubes 3 are spaced apart, i.e., between two adjacent tubes 3 in the same alignment 5 and between adjacent tubes 3 in two adjacent alignments 5, by a distance d of the order of half a tube 3 diameter.

The diameter of a tube 3 can optionally be chosen according to the diameter of the projectiles P to be stopped, in which case the diameter of the tubes 3 will advantageously be of the order of one and a half times that of the projectiles P.

This dimensioning enables the device 1 to brake the projectile P progressively by means of several tubes 3, each of which will capture a share of the projectile's energy. In fact, each tube 3 is thick enough to offer a certain resistance to the projectile P, without breaking, and sufficiently spaced from neighboring tubes 3 to be able to move and let the projectile P impact other tubes 3. In addition, such an arrangement makes it possible to present a greater number of tubes 3 to the projectiles P passing through the center of the device 1 and therefore the cylinder C according to its diameter, while making its rotation possible. The device is preferably adapted for braking projectiles P propelled by means of a weapon using compressed air energy. The device is therefore advantageously used for P projectiles with an energy of a few joules to a few tens of joules.

The motor 4 is connected to the upper face 2*b* of plate 2. The motor 4 drives the plate 2 in rotation about the axis of rotation X passing through the barycenter O of the plate. The motor 4 is connected to plate 2 by means of a connecting fastener 10 (such as a screw). The connecting screw 10 is preferably collinear with the axis of rotation X. The connecting screw 10 is attached to the top face 2*b* of plate 2 on the one hand, and to an output shaft 4*a* of motor 4 on the other. The connection between the connecting screw 10 and the plate 2 is a fixed connection which enables the connecting screw 10 to drive the plate 2 in rotation, and can be of several types, such as a bolted connection.

The motor 4 is of any type, such as an AC or DC motor, or a stepper motor, among other types.

The motor 4 rotates at a speed of between half a revolution per minute (0.5 rpm) and five revolutions per minute (5 rpm), so as to prevent two successive projectiles P from impacting the same tube 3. In this way, P projectiles do not always hit the same tube 3, due to the rotation of plate 2 and the uncertainty of the impact location due to the shooter's precision.

In one embodiment, the axis of rotation X of plate 2 is collinear with the axis of revolution of plate 2. In another embodiment, the axis of rotation X of plate 2 is angularly inclined with respect to the axis of revolution of plate 2. This alternative embodiment also allows any impacts to be spread over a greater portion of the height of each tube 3. Indeed, due to the angular inclination, the projectile P may impact a tube 3 on its lower part at the beginning of the stroke, and the last tube 3 on its upper part at the end of the stroke.

In this way, a device 1 for braking and recovering projectiles P enables a projectile P propelled in its direction to be braked, while avoiding crushing the projectile P. It also guarantees a long service life for tubes 3, thanks to the rotation of plate 2, which means that two projectiles P fired along the same trajectory and with a time lag will not impact the same tubes 3.

Advantageously, the P braking and projectile recovery device 1 may include a housing 6. The housing 6 includes a side wall 14, an upper cover 8 and a lower face 15. The housing 6 thus defines a cavity 7 within which the plate 2 and tubes 3 are positioned. The cavity 8 is defined by the casing and is large enough to contain the plate 2, the volume of the cylinder C, and the projectiles fired and dropped to the bottom of the casing 6. Nevertheless, a drawer 13 can be attached to the lower part of the casing 6 to regularly evacuate the fired and recovered projectiles P. As shown in FIG. 1, the axis of rotation X of tube 3 passes through the center of upper cover 8 and lower face 15.

The side wall of housing 6 includes a lateral opening 9 co-axial with a paper or electronic target arranged in front of it. The lateral opening 9 has a width and a height. The width of cavity 7 is of a dimension less than or equal to the diameters of the concentric alignments 5 of tubes 3, and the height of cavity 7 is of a dimension less than the length of tubes 3. The cavity 7 is preferably centered on the axis of rotation X of the cylinder C. In this way, the device 1 enables a projectile P projected along the firing axis Y towards the target to enter the cavity 7 of the device 1 and encounter at least one tube 3. Such an arrangement also enables the density of the number of tubes 3 to be matched to the concentration of projectiles P. Because the shooter's aim is to hit the center of the target, it is more common for projectiles to pass through its center than its periphery. Because the center of cavity 7 faces the axis of cylinder C, a projectile P passing through the center of cavity 7 passes diametrically through the cylinder C of tubes 3, thus hitting as many tubes 3 as possible.

In addition, cavity 7 is advantageously positioned at mid-height of tubes 3 to protect plate 2 from any projectile P impacts, while at the same time providing the greatest possible momentum to projectiles P by leaving the largest possible portion of tube 3 free below the point of impact. The casing 6 thus enables the target to be correctly positioned in relation to the cylinder C, ensuring that projectiles P impacting the center of the target pass diametrically through the cylinder C at its center.

Preferably, and as illustrated in FIG. 3, cover 8 can support motor 4 and disc 2 independently of motor 4. In other words, the weight of the disc 2 and cylinder C, i.e., the tubes 3, can be supported by the cover 8 of the housing 6 and not by the motor 4 itself, i.e., its output shaft 4*a*, via the connecting screw 10. In one embodiment, the connecting screw 10, fixed to the plate 2, passes through the cover 8 and includes, in an upper portion of the cover 8, a radial through-hole 16 into which a pin 11 is inserted. This arrangement enables the plate 2 to be locked in translation in the direction of gravity. To facilitate rotation of the connecting screw 10 relative to the cover 8, a needle stop 12 can be fitted around the connecting screw 10 and between the pin 11 and the cover 8. The pin 11 thus rests on the needle stop 12, which in turn rests on the cover 8. In this way, the plate 2 is supported by the cover 8 and is free to rotate relative to the cover 8.

Figure 4:
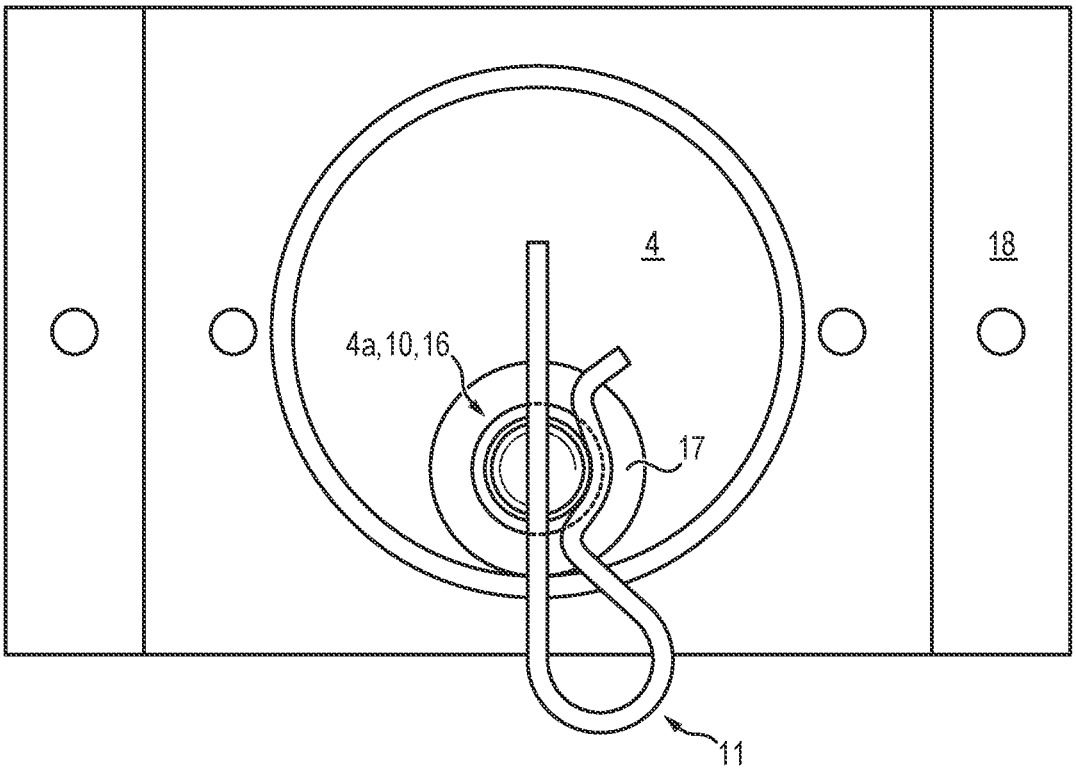
FIG. 4 is a schematic top view illustrating a motor attachment to a connecting fastener, according to another embodiment and certain aspects of the present disclosure.

The cover 8 of the housing 6 supports the motor 4. The motor 4 can be attached to an omega-shaped part 18, itself screwed to the cover 8, as shown in FIG. 4. The motor 4 is thus positioned above the connecting screw 10. The connecting screw 10 connecting the plate 2 to the motor 4 passes through the cover 8, is supported in translation by the cover 8 and is fixed to the output shaft 4*a* of the motor 4. Advantageously, the connecting screw 10 and the motor 4 output shaft 4*a* are attached to each other by means of an intermediate part 17.

In one embodiment, the intermediate part 17 is pinned to the motor 4 output shaft 4*a* and has a tenon at one end. The connecting screw 10 includes a mortise so that it can be attached to the intermediate part 17 by a mortise-tenon connection.

In another embodiment, the intermediate part 17 includes a jaw coupling, the upper half of which is fixed to the output shaft 4*a* of motor 4, and the lower half to the connecting screw 10.

Advantageously, the housing 6 may include the drawer 13. Drawer 13 is positioned in a lower part of cavity 7, beneath tubes 3, to receive projectiles P once their energy has been released.

In this way, the projectile P entering cavity 7 yields its energy to the tubes 3, is braked on contact with them, then falls into the bottom of casing 6 and is thus recoverable without it having encountered the side wall 14 of casing 6 and thus crushed.

According to a particular embodiment, the case 6 is a rectangular parallelepiped whose width and length (in a plane parallel to the ground) are between 50 millimeters (mm) and 500 mm and preferably between 200 mm and 250 mm, and whose height is between 50 mm and 600 mm and preferably between 300 mm and 400 mm. The lateral opening 9 of the housing 6 has a width and height of between 20 mm and 400 mm and preferably between 150 mm and 200 mm.

In a particular embodiment, the housing 6 is a rectangular parallelepiped with a width and length of 210 mm and a height of 360 mm. The side opening 9 of housing 6 has a width and height of 175 mm.

According to a particular embodiment, which may or may not be combined with the previous one, the diameter of the disc constituting the plate 2 is between 100 mm and 250 mm and preferably between 190 mm and 195 mm, and the height of the tubes 3 is between 200 mm and 300 mm and preferably 280 mm.

The housing 6 can include from 10 to 300 tubes 3 with a diameter of between 2 mm and 20 mm and spaced between them by 0.5 mm to 5 mm.

This braking and recovery device 1 reduces pollution in a shooting environment caused by the dispersion of lead particles in the air when a projectile stops. Indeed, this device 1 is configured to progressively brake projectiles whose energy can be between a few joules and a few thousand joules, and preferably a few tens of joules, which is considered low energy.

Braking and Recovery Device for Medium-Energy Projectiles

Figure 5B:
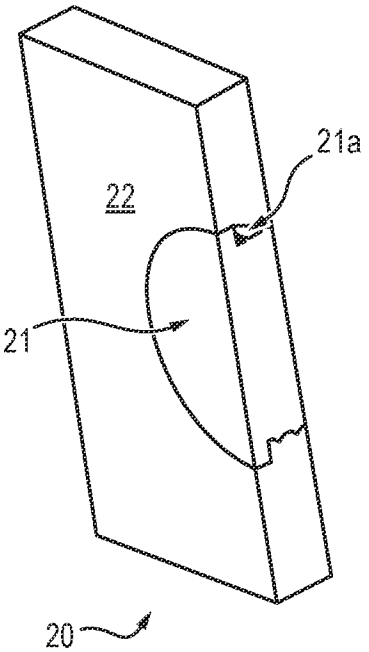
FIG. 5B is a perspective view illustrating a central part and a contour part of the braking plate of FIG. 5A, according to certain aspects of the present disclosure.
Figure 5A:
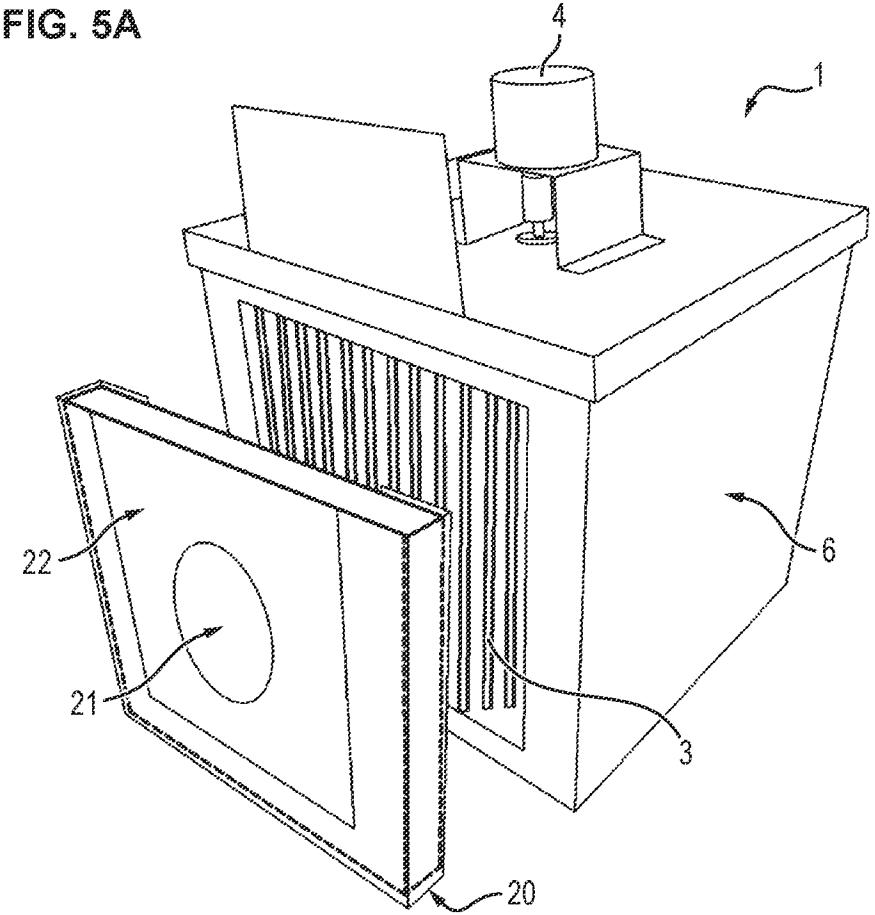
FIG. 5A is a perspective view illustrating an embodiment of a braking and projectile recovery device with a polymer braking plate, according to certain aspects of the present disclosure.

In some embodiments, the braking and recovery device 1 may include a braking plate 20, as illustrated, for example, in FIG. 5A. The braking plate 20 is configured to brake the projectile P before the projectile P encounters the braking bands 3. The braking plate 20 is positioned in the trajectory of the projectile P, between the target 200 and the braking bands 3.

The presence of the braking plate 20 improves braking and reduces wear on the braking bands 3. A braking and recovery device 1 with a braking plate 20 can therefore brake and recover higher-energy projectiles P than a braking and recovery device 1 without a braking plate 20, without damaging the projectiles or generating pollution on impact.

The braking plate 20 is made of a polymer with a thickness and hardness chosen according to the energy to be absorbed. The braking plate 20 can be made of urethane or polyurethane polymer, which closes on itself after the projectile has passed through (in other words, the plate is self-healing). The braking plate 20 is configured to be impacted by projectiles P whose energy can range from a few tens of joules to a few hundreds of joules, and more particularly up to 150 joules.

Advantageously, the braking plate 20 can include two parts: a central part 21 and a contour part 22, as illustrated for example in FIG. 5B. The central part 21 can be removed and thus easily replaced in the contour part 22. Indeed, as the central part 21 is in the middle of the braking plate 20, it is more often traversed by a projectile P than the edges of the contour part 22 (a shooter's aim being to fire at the center of the target) and is therefore more quickly worn. The central part 21 may include a shoulder 21*a* and/or grooves to avoid a possible rebound effect or backspin, and hold the central part 21 in the contour part 22 when the central part 21 is impacted by a projectile P.

Thus, by way of example, a braking and recovery device 1 according to the first embodiment disclosed above and combined with the braking plate 20 makes it possible to reduce pollution in a shooting environment caused by a dispersion of lead particles in the air during the stopping of a projectile. Indeed, this device 1 is configured to progressively brake projectiles whose energy can be between a few joules and a few thousand joules, and preferably a few hundred joules, which is considered an average energy.

Braking and Recovery Device for High-Energy Projectiles

Figure 6B:
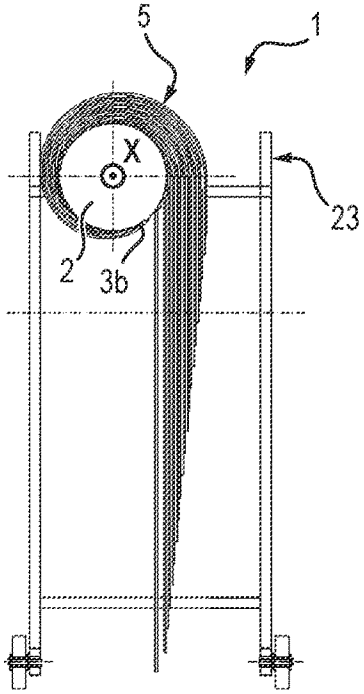
FIG. 6B is a top view illustrating the braking and projectile recovery device of FIG. 6A, according to certain aspects of the present disclosure.
Figure 6A:
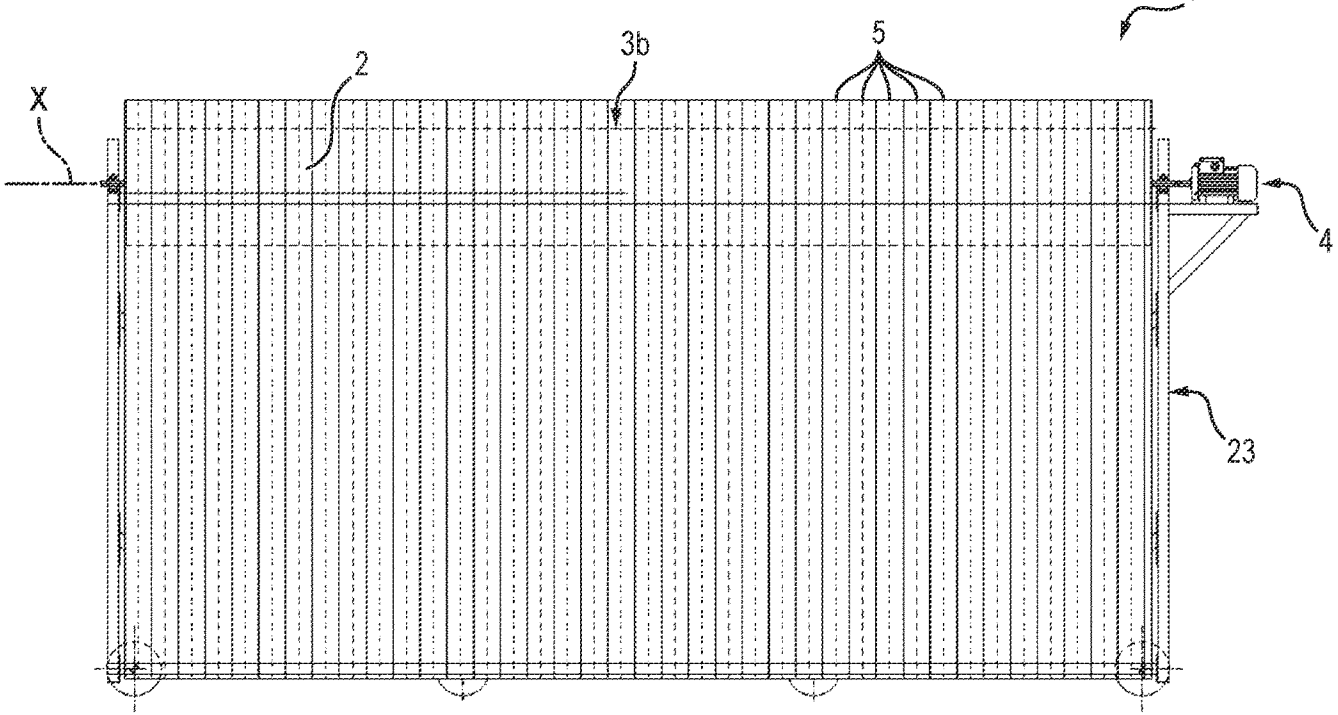
FIG. 6A is a front view illustrating another embodiment of a braking and projectile recovery device, which includes a shaft and braking tubes, according to certain aspects of the present disclosure.

According to yet another embodiment, illustrated for example by FIGS. 6A and 6B, the braking and recovery device 1 differs from the first embodiment disclosed above in that the support 2 is a shaft 2 extending around the axis of rotation X, and in that it includes braking bands 3, which hang by gravity from the shaft 2 perpendicularly to the axis of rotation X. In this embodiment, the shaft 2 therefore extends in a horizontal direction, i.e., perpendicular to the direction of gravity. The shaft 2 can be either a bar or a hollow cylinder.

The alignments 5 of the braking bands 3 are juxtaposed along the axis of rotation X of the shaft 2. Each alignment 5 consists of braking bands 3 arranged around the circumference of the shaft 2. Adjacent braking bands 3 of two adjacent alignments 5 are in contact or spaced less than 3 mm apart.

During firing, the motor 4 drives shaft 2 in rotation around axis X, so that each braking band 3 in each alignment 5 winds and then unwinds around shaft 2, due to the rotation of axis X. The braking bands 3 of the various alignments 5 thus form a curtain parallel to the axis of rotation X. The progressive winding of the braking bands 3 on the shaft 2, and thus their relative translation in the vertical plane, means that the braking bands 3 are not always impacted at the same point by a projectile aimed at the same fixed target. This also means that the projectile is not always presented with the same braking band 3, in each alignment 5, as its first obstacle, but is presented with them in turn. This increases the service life of the bands and prolongs their service life.

The motor 4 is a low-speed geared motor with a rotational speed of between 0.05 and 0.2 revolutions per minute (rpm), preferably 0.1 rpm. The shaft 2 and the motor 4 are supported by a metal structure 23.

The speed of rotation of the bar 2, and therefore the speed at which the braking bands 3 are wound around the bar 2, can be a function of the shooter's predetermined rate of fire. For example, a bar rotation speed of the order of 0.1 to 0.2 rpm induces a displacement of the braking bands 3 in the vertical direction of around 25 centimeters (cm) per minute, for a bar with a diameter of between 180 mm and 400 mm. Such a displacement of the braking bands 3 contributes to improving their longevity. Indeed, a first projectile P can impact a first braking band 3 in a first part of the strap, close to the attachment of the braking band 3 to the bar 2. And, a second projectile P following the first projectile P by a time interval during which the braking band 3 rotates and winds up the first braking band 3, impacts the first braking band 3 in a part of the braking band 3 different from the first part, and further from the attachment of the braking band 3 to the bar 2 than the first part due to the winding of the braking band 3 around the bar 2.

In addition, a projectile that gets stuck in one of the braking bands 3 can be detached based on the relative sliding movement between one braking band 3 and an adjacent braking band 3 induced by winding/unwinding around the bar 2.

Advantageously, the metal structure 23 supports a long shaft 2, such as a length corresponding to several shooting stations, e.g., 5 times 0.75 meters (m) for 5 sport shooting stations. Alternatively, it can support a shaft 2 of a length corresponding to a single shooting station, i.e., 0.75 m. In the latter case, several sets of shooting stands are linked together to form sets of 1, 2, 3, 4 or 5 shooting stands. Whether the structure includes 1 or more firing points, the shaft is rotated by the motor 4 in each case.

Whether it is a single-shot or a multiple-shot device, the assembly can be moved in translation (e.g., by means of feet accommodating lockable castors) in relation to one or more targeting systems 200. This not only adapts to the needs of a shooting range, but also enables wear to be distributed evenly across all the braking bands 3. The braking and recovery device 1 simply needs to be translated along the axis of rotation X.

Each braking band 3 is optionally in the form of a strip with a width of between 10 mm and 300 mm, but preferably 100 mm, and a thickness of between 1 mm and 10 mm, preferably 8 mm. The width and thickness of the braking bands 3 are chosen according to the energy of the projectiles P to be absorbed. The braking bands 3 are optionally made of a polymer, such as a polyvinyl chloride (PVC) material. Preferably, the braking bands 3 are optionally made of crystal PVC and have a hardness of between 30 and 80 shore A, and preferably between 50 and 70 shore A.

To prevent a projectile P from passing between the braking bands 3 of two adjacent alignments 5 without being braked, each braking band 3 of the same alignment 5 is respectively offset by half a width with respect to each of the adjacent braking bands 3 in the alignment 5 in question. Alternatively, the braking bands 3 of two adjacent alignments 5 are positioned in a staggered configuration.

The number of braking bands 3 per alignment 5 depends on the desired thickness for absorbing projectile energy. In other words, the number of braking bands 3 per alignment 5 is a function of the energy of the projectiles to be braked. The number of braking bands 3 per alignment 5 is optionally, for example, between 5 and 30 braking bands 3. Preferably, for braking projectiles whose energy is of the order of a thousand joules, the number of braking bands 3 per alignment 5 is optionally 18, and for braking projectiles whose energy is of the order of a hundred joules, the number of braking bands 3 per alignment 5 is optionally 5 or 12.

Thus, a braking and recovery device 1 according to any of the embodiments disclosed above makes it possible to reduce pollution in a shooting environment caused by the dispersion of lead particles in the air when a projectile stops. Indeed, depending on the number of braking bands 3, this device 1 is configured to progressively brake projectiles whose energy may be between a few joules and a few hundred joules, or even a few thousand joules, which is considered a high energy.

In addition, the rotation of the braking bands 3 improves the longevity of the braking bands 3, as explained above, and therefore guarantees good braking of projectiles for longer without the need to change the braking bands 3.

The braking plate 20 described above is optionally used with the alternative type of braking device disclosed above.

Target

Figure 7:
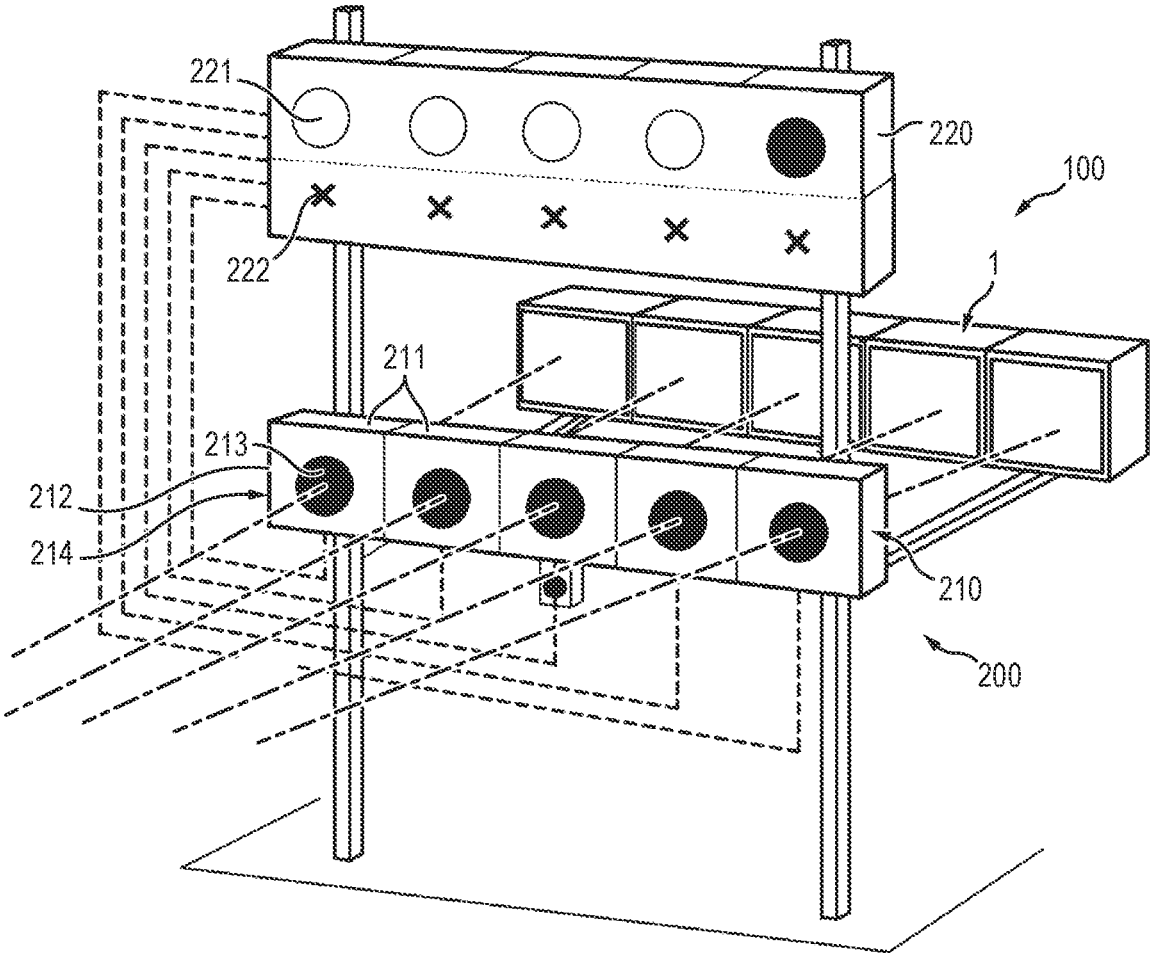
FIG. 7 is a perspective view illustrating a targeting system according to yet another embodiment of the present disclosure, enabling projectile recovery without destroying the projectile, according to certain aspects of the present disclosure.

The target 200 of the 100 targeting system can be electronic, as shown in FIG. 7. This not only improves the accuracy of shot readings, but also avoids contact between the target 200 and the projectile P, which can release lead particles, as in the case of targets used in biathlon, known as tipping targets.

The projectile P can, thus, pass through the target 200, the accuracy of the shot being measured electronically, and then enter the braking and recovery device 1 for recovery.

Target 200 may include an aiming zone 210 and a display zone 220.

The aiming zone 210 (or target display) may include one or more frames 211, each including a detection device 212 and an aiming device 213. Each frame 211 is configured to be traversed by a projectile P and is associated with a braking and recovery device 1 into which the projectile discharges after traversing the frame 211. The aiming device 210 is configured to give indications to the shooters on the area to be reached in frame 211 with the projectile P. The detection device 212 is configured to detect the passage of a projectile P through frame 211 and the position of the projectile P in order to determine whether the projectile P has reached the area to be reached. The 212 detection device may include one or more 214 sensors, such as infrared, laser or optical sensors.

The display zone 220 is configured to indicate to the shooter whether the projectile P has hit the target zone of the frame 211 in question. The display zone 220 can therefore include, for each frame 211 of the aiming zone 210, a success indicator 221, such as a color palette, for example white, activated according to an electronic signal from the detection device 212. The display zone 220 can also include, for each frame 211 of the aiming zone 210, a shot indicator 222 to inform a spectator whether the shot has been taken or not.

The electronic target 200 enables the function of a mechanical target to be fulfilled without inducing contact with the projectile P. A projectile P fired in the direction of a target 200 therefore passes through the frame 211 of the aiming zone 210, its passage through the frame 211 is detected by the detection device 212, and the projectile P then enters the braking and recovery device 1.

In this way, the electronic target 200, together with the braking and recovery device 1, facilitates the firing of a projectile P towards a given target area, improves the accuracy of the reading and enables the projectile to be braked and recovered without crushing the projectile against a wall.

Although the disclosed embodiments have been illustrated and described with respect to one or more implementations, equivalent alterations and modifications will occur or be known to others skilled in the art upon the reading and understanding of this specification and the annexed drawings. In addition, while a particular feature of the invention may have been disclosed with respect to only one of several implementations, such feature may be combined with one or more other features of the other implementations as may be desired and advantageous for any given or particular application.

While various embodiments of the present disclosure have been described above, it should be understood that they have been presented by way of example only, and not limitation. Numerous changes to the disclosed embodiments can be made in accordance with the disclosure herein, without departing from the spirit or scope of the disclosure. Thus, the breadth and scope of the present disclosure should not be limited by any of the above described embodiments. Rather. the scope of the disclosure should be defined in accordance with the following claims and their equivalents.

What is claimed is:

1. A device for braking and recovering projectiles, the device comprising: a support from which several braking tubes are suspended, the braking tubes being suspended by one of their ends on the support, wherein the braking tubes are arranged on the support in a plurality of annular alignments; and a motor driving the support in rotation about an axis of rotation, wherein the support is a shaft extending around the axis of rotation, and each one of plurality of annular alignments is arranged around the support along the axis of rotation of the support; wherein the braking tubes are suspended from the support by gravity so as to absorb the energy of a projectile impacting one or more of the several braking tubes.

2. The device claim 1, wherein the braking tubes are arranged around the axis of rotation.

3. The device claim 2, wherein the support is a plate whose axis of rotation is parallel to the braking tubes, the braking tubes being suspended by one end on a lower face of the support, the plurality of annular alignments being concentric.

4. The device of claim 3, wherein adjacent braking tubes of the same alignment and adjacent braking tubes of adjacent alignments are spaced apart by a distance greater than 1 millimeter (mm) and less than a diameter of the braking tubes.

5. The device of claim 3, wherein each straight line passing through a center of rotation of the plate intercepts at least one of the braking tubes of at least one of the plurality of annular alignments.

6. The device of claim 1, wherein the support is perpendicular to the braking tubes hanging, each one of the plurality of annular alignments being juxtaposed along the axis of rotation of the support.

7. The device of claim 1, wherein the support further includes for each braking tube of the braking tubes:

a hole in which the braking tube slides freely; and a shoulder for securing the braking tube to the support, the shoulder being wider than the hole in the support into which the braking tube is inserted.

8. The device of claim 1, further comprising a housing defining a cavity within which the support and the braking tubes are positioned, the housing including a lateral opening that is parallel to the axis of rotation of the support, the lateral opening being configured as an entry to receive projectiles into the device.

9. The device of claim 8, wherein the motor is positioned on a top cover of the housing and outside the cavity, the motor being connected to a disc via a connecting fastener that is fixed to the disc and to the motor, the connecting fastener passing through the top cover.

10. The device of claim 9, wherein the disc is supported by the top cover via the connecting fastener and a pin, the pin locking the connecting fastener in translation with respect to the top cover of the housing, the disc being further supported via a needle stop on which the pin rests and which allows rotation of the connecting fastener relative to the cover.

11. The device of claim 1, further comprising a braking plate for braking a projectile, the braking plate being positioned parallel to the axis of rotation and perpendicular to a trajectory of a projectile, the braking plate being configured to brake the projectile before the projectile impacts one or more of the braking tubes.

12. The device of claim 11, wherein the braking plate is made of polyurethane.

* * * * *